US007832123B2

(12) United States Patent
Fallon et al.

(10) Patent No.: US 7,832,123 B2
(45) Date of Patent: Nov. 16, 2010

(54) TEAM SHOE SET WITH DIFFERING UPPER CHARACTERISTICS

(75) Inventors: Kevin P. Fallon, Portland, OR (US); Craig E. Santos, Portland, OR (US)

(73) Assignee: Nike, Inc., Beaverton, OR (US)

( * ) Notice: Subject to any disclaimer, the term of this patent is extended or adjusted under 35 U.S.C. 154(b) by 876 days.

(21) Appl. No.: 11/461,226

(22) Filed: Jul. 31, 2006

(65) Prior Publication Data

US 2007/0137068 A1 Jun. 21, 2007

Related U.S. Application Data

(63) Continuation-in-part of application No. 11/300,584, filed on Dec. 15, 2005, now abandoned.

(51) Int. Cl.
*A43B 5/00* (2006.01)

(52) U.S. Cl. ..... 36/100; 36/15

(58) Field of Classification Search ..... 36/15, 36/100, 101, 88, 50.1
See application file for complete search history.

(56) References Cited

U.S. PATENT DOCUMENTS

| | | | | | |
|---|---|---|---|---|---|
| 3,538,628 | A * | 11/1970 | Einstein, Jr. | ..... | 36/15 |
| 4,103,440 | A * | 8/1978 | Lawrence | ..... | 36/101 |
| 4,279,083 | A * | 7/1981 | Dilg | ..... | 36/101 |
| 4,377,042 | A * | 3/1983 | Bauer | ..... | 36/101 |
| 4,577,419 | A * | 3/1986 | Chassaing | ..... | 36/89 |
| 4,651,447 | A * | 3/1987 | Sullivan | ..... | 36/137 |
| RE32,585 | E * | 2/1988 | Antonious | ..... | 36/50.1 |
| 4,766,682 | A * | 8/1988 | Malloy, III | ..... | 36/132 |
| 5,109,613 | A * | 5/1992 | Van Dyke | ..... | 36/89 |
| 5,271,130 | A * | 12/1993 | Batra | ..... | 24/714.6 |
| 5,323,549 | A * | 6/1994 | Segel et al. | ..... | 36/140 |
| 5,497,564 | A * | 3/1996 | Allen et al. | ..... | 36/50.1 |
| 5,771,608 | A * | 6/1998 | Peterson | ..... | 36/89 |
| 5,819,439 | A * | 10/1998 | Sanchez | ..... | 36/89 |
| 5,983,528 | A * | 11/1999 | Hartung | ..... | 36/15 |
| 6,023,859 | A * | 2/2000 | Burke et al. | ..... | 36/105 |
| 6,915,596 | B2 * | 7/2005 | Grove et al. | ..... | 36/100 |
| 7,111,416 | B2 * | 9/2006 | Gallegos | ..... | 36/100 |
| 2004/0148803 | A1 * | 8/2004 | Grove et al. | ..... | 36/103 |

* cited by examiner

*Primary Examiner*—Marie Patterson
(74) *Attorney, Agent, or Firm*—Banner & Witcoff, Ltd.

(57) ABSTRACT

A set of shoes for use by members of a team. The shoes allow for a uniform appearance in a team environment by way of substantially similar uppers, while providing individualized performance specifications, with respect to support and breathability, for each upper. The substantially similar appearance of the upper may be due to material overlays, stitch patterns, color scheme and/or perforations and may be based on team criteria. The uppers are materially different from each other due to internal or external supports, material types and/or breathability. The substantially similar upper provides a uniform appearance for the team. The individualized performance specifications of each upper provide the comfort, performance and/or safety preferences desired by each player.

19 Claims, 10 Drawing Sheets

TEAM SHOE SET WITH DIFFERING UPPER CHARACTERISTICS

CROSS REFERENCE TO RELATED APPLICATIONS

This application is a continuation-in-part of pending U.S. application Ser. No. 11/300,584, filed Dec. 15, 2005, entitled "Team Shoe Set with Differing Soles," whose contents are expressly incorporated by reference.

FIELD OF THE INVENTION

This invention relates to the field of footwear. More specifically, the invention relates to sets of athletic shoes for use by teams and squads.

BACKGROUND OF THE INVENTION

Athletic shoes can be thought of as having two major components, an upper and a sole. The upper is secured to the sole and provides a cavity for receiving a foot. The upper is generally formed from multiple elements stitched or adhesively bonded together to form a structure for comfortably receiving a foot.

The sole is the interface between the foot and ground and is intended to provide traction, support and cushioning for the wearer. Many soles have a multi-part construction including an outsole and a midsole. The outsole is generally designed for durability and traction. The midsole is commonly designed to absorb the force created as the shoe contacts the ground. There are a number of different cushioning systems that have been used in midsole designs. Some examples of these cushioning systems that are known in the art include: column type supports (including such that have been marketed by NIKE, INC. under the trademark NIKE SHOX®), a foam puck type support (including such that have been marketed by NIKE, INC. under the trademark IMPAX™), foam units, bladders with or without internal tensile elements, as well as several others.

Most team sports require players to wear a uniform. The purpose of the uniform is to identify each player as a member of the team, as well as to provide a sense of unity among the team and a symbol that an outsider can easily associate with the team.

Uniformed shoes have been used as part of the uniform. A uniform shoe gives each player a shoe identical in appearance, i.e., identical upper and sole, and function. Thus, for some teams, each player wears the same shoe design with each model differing only for size. While a team shoe satisfies the need for a uniform appearance, each individual player may have differing needs for comfort, performance and/or safety.

SUMMARY OF THE INVENTION

The following is a simplified summary of the invention to provide a better understanding of some aspects of the invention. It is not intended to be an extensive overview of the invention or aspects thereof. Nor is it intended to identify or define critical elements of the invention. This summary merely describes some aspects of the invention in a simplified manner as a prelude to the detailed description hereinafter.

To maximize a player's performance, the individual needs of each player must be considered. One aspect of the present invention provides a team set of articles of footwear that present a uniform appearance by way of an upper that is substantially similar in appearance to others but provides the comfort, performance and safety characteristics that each player requires by way of an individualized upper. Each individualized upper may include differences in performance specifications with respect to material type, material thickness, internal supports, external supports, breathability and the like. Each shoe of the team set may include the same sole as all others.

In another aspect of the invention, a team set of articles of footwear may include an upper that is substantially similar in appearance to others in the set, while providing the comfort, performance and safety characteristics that each player requires by way of an individualized upper. Each individualized upper may include differences in performance specifications with respect to material type, material thickness, internal supports, external supports, breathability and the like. Each shoe of the team set may also include an individualized sole. The individualized sole may include the cushioning type selected by a player to maximize the comfort, cushioning, safety and performance for that player.

Additional objects of the invention will be evident from the figures and detailed description below.

DETAILED DESCRIPTION

In the following description of the various embodiments, reference is made to the accompanying drawings that depict illustrative arrangements in which the invention may be practiced. It is understood that other embodiments may be utilized and modifications may be made without departing from the scope of the present invention. Additionally, various terms used herein are defined below.

The term "team" is herein defined as an association of participants in a sport or variety of events within a sport or sporting event, who represent a common entity.

As used herein, the term "team set of shoes" is defined as at least two pairs of articles of footwear used by participants in a sport on a common team.

As used herein, the term "differing soles" is defined as two pairs of soles within the set of shoes that have either different midsoles or different outsoles. The differing midsoles may include several cushioning types that are well known in the art, e.g., foam only, fluid containing bladder with the fluid being gas, liquid or gel, column type support (including such that have been marketed by NIKE, INC. under the trademark NIKE SHOX®), bladder/foam mix, foam puck type support (including such that have been marketed by NIKE, INC. under the trademark IMPAX™) or bladder with tensile elements.

As used herein, the term "matched upper" is herein defined as shoe uppers of different pairs having a generally similar or identical external appearance formed by overlay shapes, stitch designs and/or perforations regardless of size and/or proportion.

The term "color matched upper" is herein defined as a "matched upper" having a substantially similar color scheme.

The term "substantially similar upper appearance" is herein defined as shoe uppers of different pairs having a generally similar external appearance formed by overlay shapes, stitch designs and/or perforations, regardless of size and/or proportion of the shoe. Shoes having a substantially similar upper appearance may differ in their construction. For instance, the uppers may have a substantially similar appearance, however, the uppers may differ in the type of material from which it is formed, the thickness of the material of the upper, internal supports, external supports that are visible but do not materially change the external appearance of the upper.

Figure 1A:
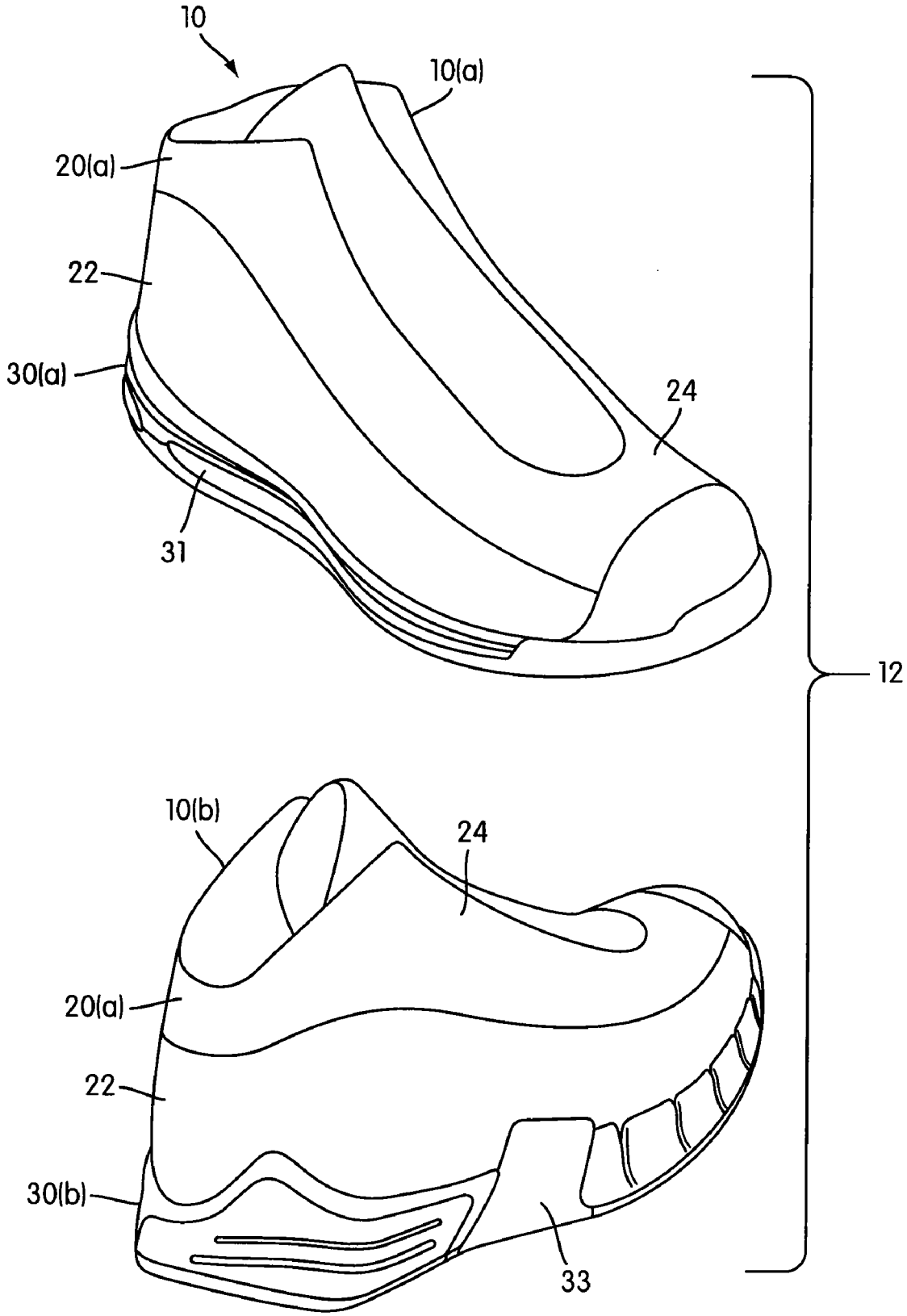
FIG. 1A is a perspective view of a set of articles of footwear according to an aspect of the present invention.
Figure 1B:
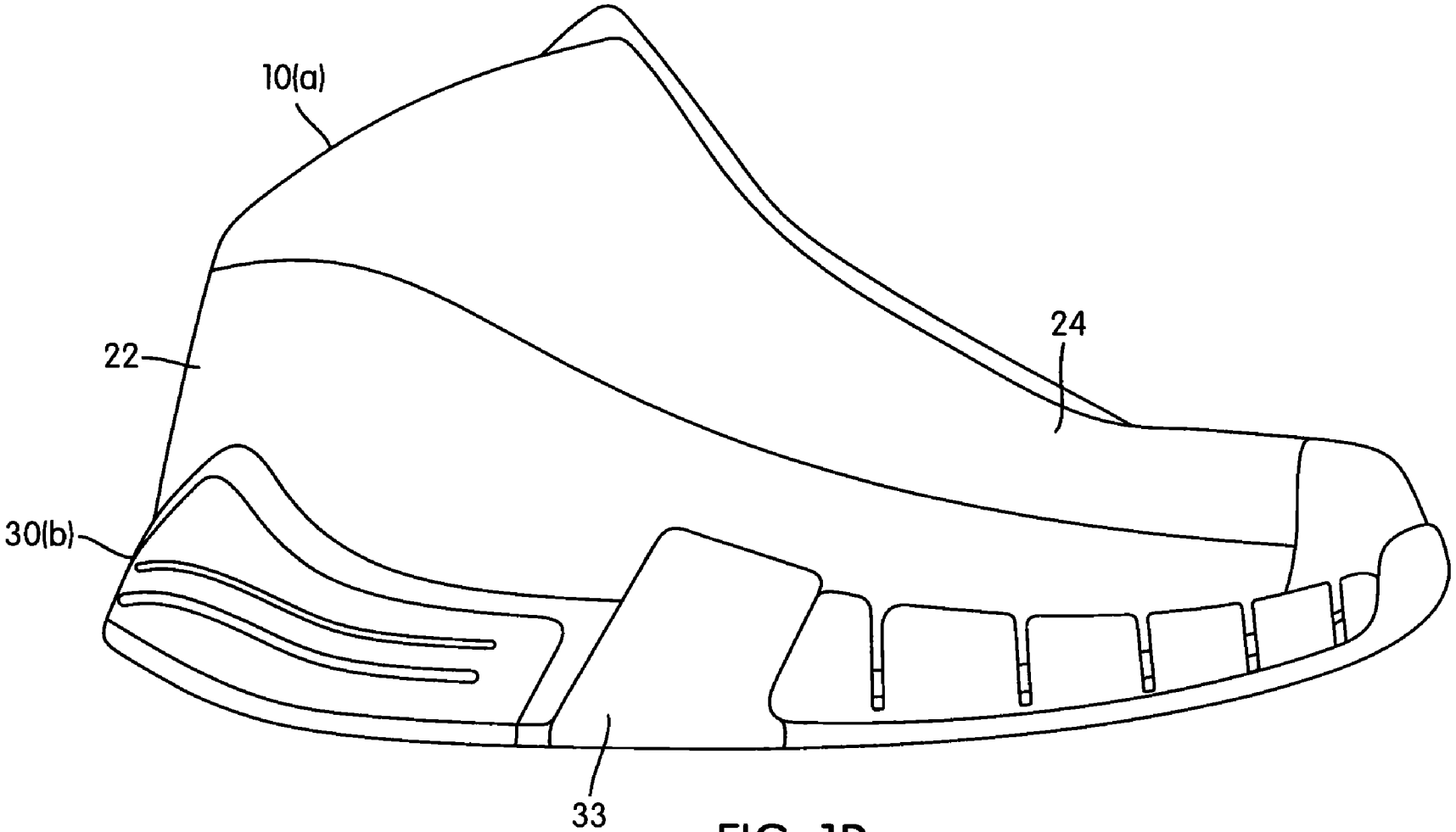
FIG. 1B is a lateral side view of one shoe from the set of articles of footwear shown in FIG. 1A.
Figure 1C:
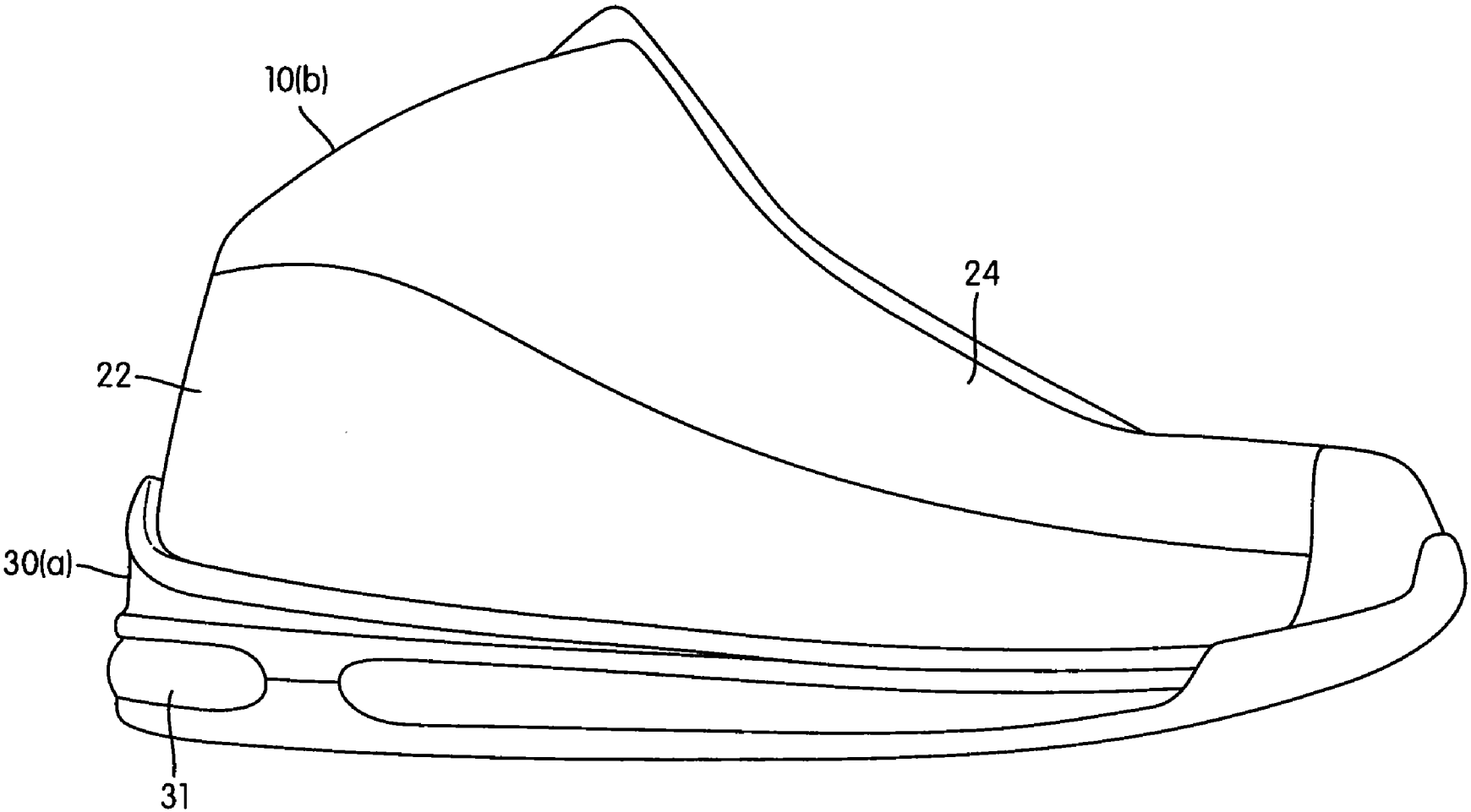
FIG. 1C is a lateral side view of a second shoe from the set of articles of footwear shown in FIG. 1A.
Figure 1D:
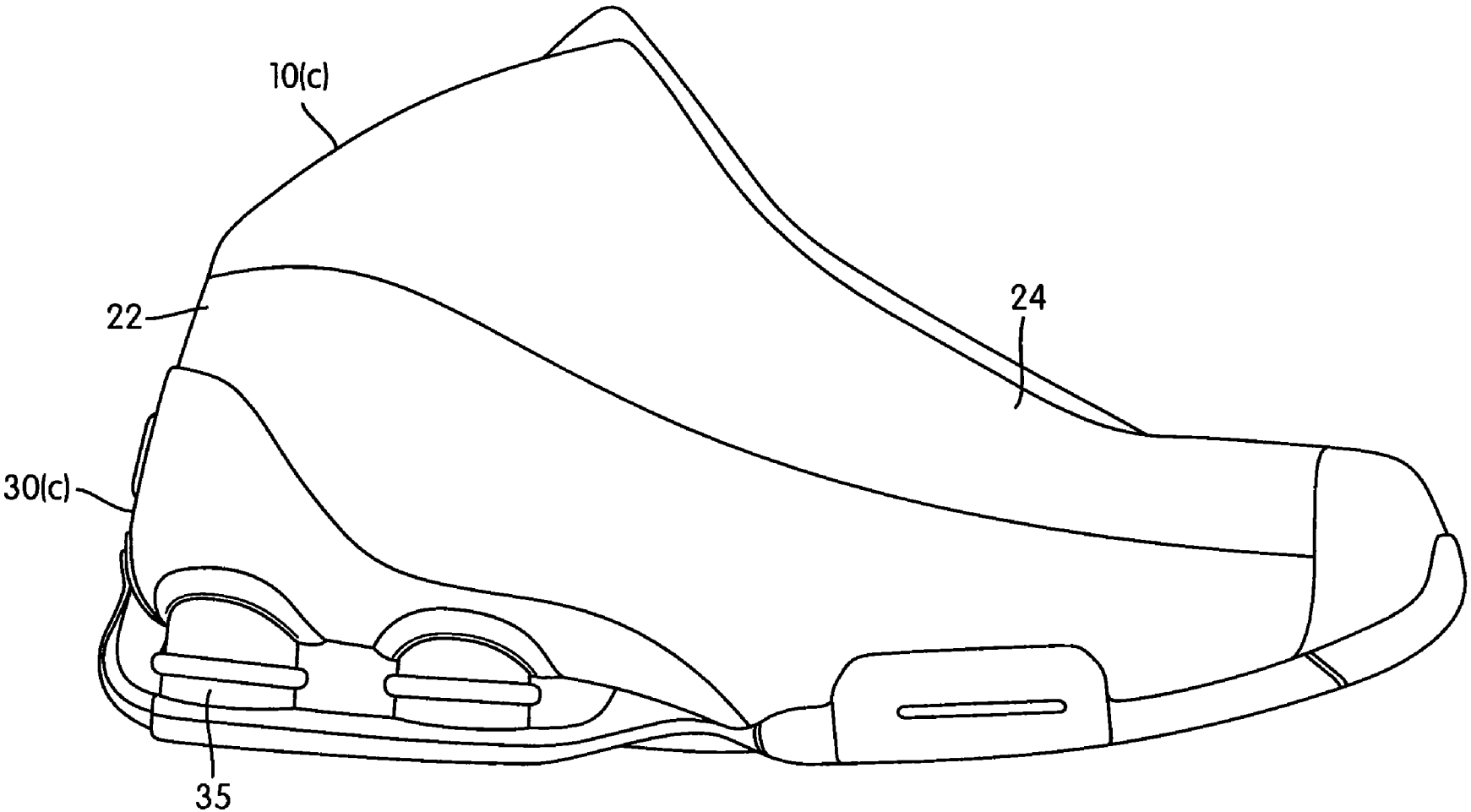
FIG. 1D is a lateral side view of a third shoe from the set of articles of footwear that could be included as part of the set of articles of footwear shown in FIG. 1A.
Figure 2:
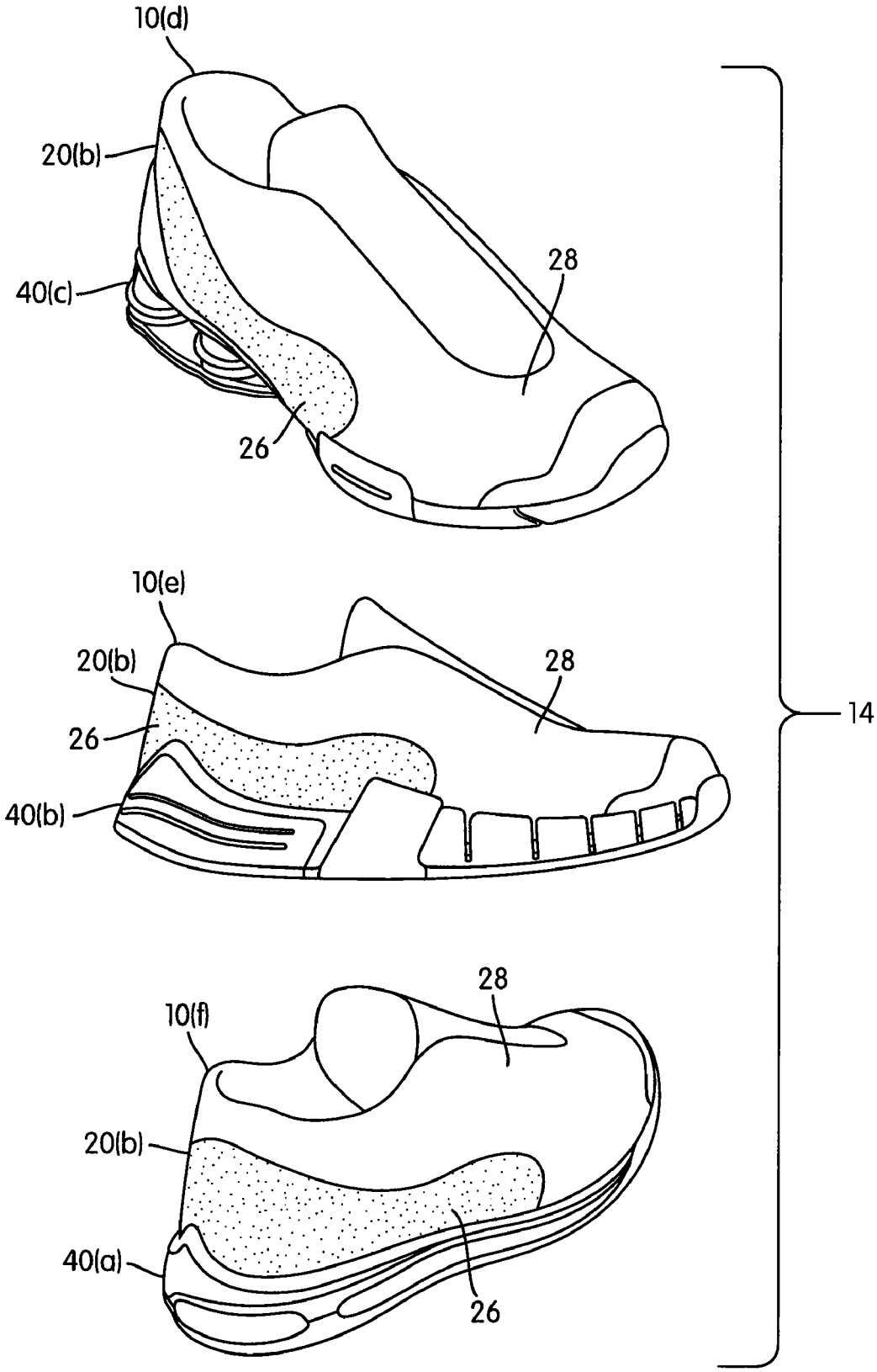
FIG. 2 are perspective and side views of articles of footwear according to an aspect of the present invention.

A set of articles of footwear, e.g., a set of shoes, is shown in FIGS. 1-2 and is designated generally by reference numeral 10. As will be evident from the description below, the shoe is part of a set of shoes intended to provide a uniform appearance while allowing each wearer to have the sole structure that best suits each individual player's performance needs or preferences. The ability to individualize each shoe within the set provides each player with the opportunity to have the under foot support, such as a cushioning type, necessary to maximize comfort, performance and/or safety.

FIG. 1A shows a first embodiment of the present invention. FIG. 1A depicts a set 12 of shoes made up of two different shoes 10(*a*), 10(*b*). Each shoe 10(*a*) and 10(*b*) is one half of a separate pair. The shoes 10(*a*) and 10(*b*) in the set have matched uppers 20(*a*).

The varying perspective views of shoes 10(*a*) and 10(*b*) illustrate the matched upper 20(*a*) of the shoes. The matched uppers results from the uppers having a similar or identical appearance based on the overlay shapes, stitch designs and/or perforations used, regardless of size and/or proportion. In addition, the tongue portions may be identical to the other shoes in the set and any additional support elements used, e.g., a strap, additional material overlapping the base material, may be generally identical. These additional support elements may be arranged to provide additional support to the player's foot where needed, while also contributing to the general appearance of the shoe. Any ornamental design or team logos may also be generally identical in order to maintain the matched appearance of the uppers. The figure depicts the upper in the most generic of designs to indicate that the uppers are substantially similar, regardless of the design pattern employed.

FIG. 1A further illustrates pairs of the team set of shoes as having differing sole units 30(*a*) and 30(*b*). The sole 30(*a*) of shoe 10(*a*) differs from the sole 30(*b*) of shoe 10(*b*), as depicted. Sole 30(*a*) uses one cushioning type while sole 30(*b*) uses an alternative cushioning system. The differing sole units 30(*a*), 30(*b*) are intended to provide the cushioning system or type specific to each player's needs that assists to maximize that player's performance, comfort and safety.

As shown in FIG. 1A, sole 30(*a*) employs a bladder type cushioning system in the midsole, while sole 30(*b*) employs a foam type cushioning system in the midsole. While those are two commonly used types of cushioning systems, as discussed above, they are not the only types available for use with this invention. Any combination of cushioning systems in different shoes in the set, including all of the cushioning systems recited in this specification, are contemplated as being in part of the set of shoes.

FIGS. 1B-1D depict a detailed view of the individual shoes of the present invention. FIG. 1B shows an enlarged side view of shoe 10(*a*) from FIG. 1. FIG. 1C shows an enlarged side view of shoe 10(*b*) from FIG. 1. FIG. 1D is a side view of a third shoe 10(*c*) that could be included as part of the set of articles of footwear shown in FIG. 1A. Each shoe depicted, 10(*a*), 10(*b*) and 10(*c*), is seen from the lateral side. This lateral view provides a clear illustration of the features of the present invention. Each shoe, 10(*a*), 10(*b*) and 10(*c*) is seen to have a matched upper 20(*a*), 20(*b*), and 20(*c*). In this example, the uppers 20(*a*)-20(*c*) have matched uppers formed by similar shaped lower and upper side panels 22 and 24, respectively.

The matched uppers 20(*a*)-20(*c*) may also bear colors having similar colors in similar locations making them "color matched uppers". For example, the lower side panel 22 of the uppers 20(*a*)-20(*c*) may be a first color. The upper lower side panel 24 of the uppers 20(*a*)-20(*c*) may be a second color, different than the first color.

This color matched upper may represent the colors of a given team. The appearance of the upper of shoes 10(*a*), 10(*b*) and 10(*c*) may also be virtually identical.

FIGS. 1A-1D illustrate other aspects of the set of shoes. FIG. 1B shows shoe 10(*a*) having the matched upper 20(*a*) with a sole unit 50(*a*) that employs a foam type cushioning system in the midsole. A portion of the outsole 33 may also wrap up onto the side of the upper to provide additional support. FIG. 1C shows shoe 10(*b*) having an upper 20(*c*) and a sole unit 50(*b*) that uses a bladder type cushioning system in the midsole. In this illustrative arrangement, the bladder element 31 is externally visible. FIG. 1D shows shoe 10(*c*) having an upper 20(*c*) and a sole unit 50(*c*) that uses a column type cushioning system in the midsole with multiple column elements 35. Although these three particular cushioning types are depicted in the figures, the present invention is not limited to only these types of cushioning systems.

Accordingly, the shoes of FIGS. 1A, 1B, and 1C are examples of shoes 10(*a*), 10(*b*) and 10(*c*) having matched uppers but have differing sole units. In the depicted embodiment, the sole units each also have different cushioning types. In an embodiment not shown, the sole units may have different outsoles. The matched uppers provide the uniform appearance desired by members of a team, while the differing sole units allow for a shoe that meets each individual players needs in order to maximize comfort, performance and safety.

FIG. 2 shows a second embodiment of the current invention. The team set of shoes 14 of FIG. 2 illustrates three shoes 10(*d*), 10(*e*) and 10(*f*) that are exemplary of three pairs of shoes contained in this team set of shoes. The team set of shoes 14 have matched uppers 20(*b*), but the upper design 20(*b*) is different from the upper design 20(*a*) depicted in FIGS. 1A-1D. Each shoe 10(*d*), 10(*e*), 10(*f*) of this figure utilizes a different sole unit design. In this embodiment, the sole units 40(*a*), 40(*b*), 40(*c*) also have a different cushioning type.

Accordingly, the shoes of FIG. 2 are also examples of shoes 10(*d*), 10(*e*) and 10(*f*) having matched uppers but have differing sole units. In the depicted embodiment, the sole units each also have different cushioning types. In an embodiment not shown, the sole units may have different outsoles. The matched uppers provide the uniform appearance desired by members of a team, while the differing midsoles allow for each team member to individualize his or her shoe to provide a user-preferred cushioning system. Such a selection may be based on what the user prefers and may take into account the requirements of the team member or player, such as medical needs, performance needs, personal preference, and the like.

For example, team member 1 may require additional spring in the midsole for enhanced performance and may choose a column type cushioning system. Team member 2 may have medical needs requiring more stability in the midsole to prevent ankle injuries and may choose a foam type cushioning system to provide that additional stability. Team member 3 may desire a lightweight shoe and may choose a bladder type cushioning system. Team member for may prefer the look of the foam puck type support and may choose that cushioning type. Although each team member may choose the midsole that accommodates his or her needs, each shoe has a matched upper.

In addition, the set of shoes depicted in FIG. 2 depict a set of shoes with each shoe having a matched upper and a different midsole. However, the invention is not limited to an arrangement wherein each member of a team has a shoe with a midsole different from all others on the team. For instance, on a team of five players, team members 1, 2 and 3 may each choose one of the midsole cushioning types depicted in the set of shoes in FIG. 2. The remaining two players, team members 4 and 5, may choose a shoe with a matched upper having a different midsole from those depicted in FIG. 2 or may choose a shoe having the same midsole as one of players 1, 2 or 3.

It is understood that the upper designs shown in the figures are merely illustrative and that any desired set of matching uppers could be used. Additionally, the two distinct sections of the upper shown are merely illustrative of how color may be used in the upper. The present invention is not limited to the use of color in only two sections.

The present invention is well suited for sports teams with multiple players. For instance, a basketball team may require a shoe with a uniform appearance. However, one player may require greater stability in his sole, while another may require increased cushioning. Some teams have required each member of the team to wear identical shoes, thereby sacrificing the ability to meet the needs of each individual player. Other teams have allowed each player to choose a shoe that meets his performance needs while maintaining a common color scheme for the upper. Rather than requiring each player to wear a shoe that may not meet his needs, or allowing each player to wear different shoes and sacrifice the appearance of a team shoe, the present invention provides the uniform appearance desired, as well as satisfies the performance requirements of each individual player.

In another example, the members of a running team may require different sole arrangements to accommodate each member's running style, e.g., whether the runner is a rearfoot, forefoot or midfoot runner, or over or under pronates. The present invention can satisfy the performance needs of each runner while allowing them to maintain their team appearance.

In addition, the present invention is not restricted to use by teams on which each player participates in the same sport. For instance, members of a track and field team participating in different events have different needs in their article of footwear. A long-jumper could not perform to the best of his abilities in the same shoe as a distance runner. Although each participant is involved in a different activity, they are all part of a team. The present invention would provide the appearance of a team shoe by way of the uniform upper. However, it would allow each participant to have the appropriate sole for his or her activity and performance needs, coupled to the uniform upper.

The present invention is not restricted to use by players on a team. The uniform appearance of these shoes would allow coaches, trainers and others in positions of support to appear as part of the team while having the comfort of the cushioning type that best suits their needs. For instance, a basketball team trainer may spend most of his time standing or crouching. His shoe could have the same matched upper as that of the players on the team. However, his sole could be of a cushioning type that would provide better support for standing and more flexibility to accommodate the bend of the foot when the trainer is crouching to attend to a player on the floor.

Further, the present invention may be provided as part of a kit. Such a kit may include a plurality of pairs of shoes, each pair with an upper matched to the other pairs, but having differing soles. The differing soles may be due to different cushioning types used in the midsole or different outsoles. The multiple pairs of shoes could be shipped in one container via a common carrier to a single destination.

Figure 3:
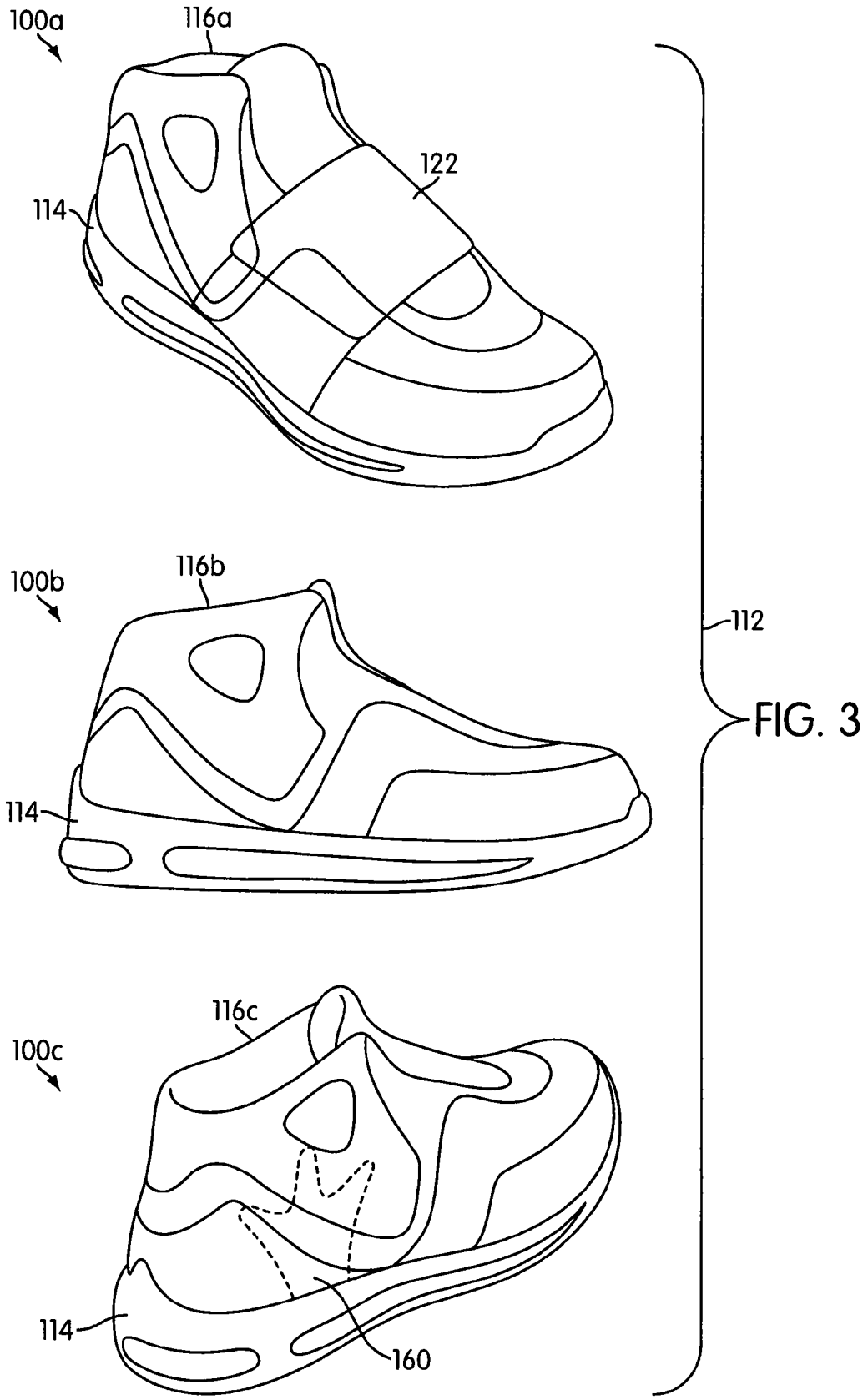
FIG. 3 is a perspective view of another arrangement of the set of articles of footwear according to aspects of the present invention.

Another arrangement of the team set 112 of shoes is shown in FIG. 3. The shoes 100(*a*), 100(*b*), 100(*c*) of the set 112 are each one half of a pair of shoes within the set 112. Each shoe 100(*a*), 100(*b*), 100(*c*) includes an upper 116(*a*), 116(*b*), 116(*c*) and a sole 114. The soles of each shoe 100(*a*)-100(*c*) of the set 112 may be identical, as shown in FIG. 3.

The varying perspective views of shoes 100(*a*), 100(*b*) and 100(*c*) depict the uppers 116(*a*), 116(*b*), 116(*c*) having a substantially similar appearance. This substantially similar upper appearance may be due to material overlays, stitch patterns, perforations, and the like, that provide the same general appearance for each upper 116(*a*)-116(*c*) within the set 112.

Although the uppers 116(*a*)-116(*c*) have a substantially similar appearance, each upper may be materially different from the others based on the performance specifications of the upper. The performance specifications may include support characteristics of the upper, such as material thickness, material type, additional layers of material, support straps, internal supports (i.e., a paw type support), or other external supports. In addition, the performance specifications may include "breathability" characteristics of the upper, such as material type or perforations within the upper material. For instance, an upper 116(*a*) may include an additional support strap 122 on the exterior of the upper. The support strap 122 may provide additional support for the foot of the player. In one embodiment, the support strap 122 shown continues the pattern of the upper, thereby maintaining the general appearance of the upper. Although the strap 122 may be included in the upper 116(*a*), is does not materially change the general outer appearance of the upper 116(*a*).

Another example is seen in shoe 100(*b*). The upper 116(*b*) of shoe 100(*b*) may be formed of a stiff material, such as leather, to provide additional support to the foot of the player. Although the upper 116(*b*) has a substantially similar appearance to other uppers 116(*a*), 116(*c*) within the set 112, it differs from the others in that it provides additional ankle support throughout the upper, by way of the stiffer material.

Yet another example is seen in shoe 100(*c*) of the set 112. The upper 116(*c*) of shoe 100(*c*) may have additional support built into the shoe 100(*c*). For instance, the shoe 100(*c*) may include a paw type support 160 built into the shoe 100(*c*), as seen in FIG. 3. This may provide additional ankle support for a player who requires it, although the paw support 160 is not seen from the exterior of the shoe 100(*c*) and therefore does not alter the outer appearance of the upper 116(*c*). Upper 116(*c*) has a substantially similar appearance to upper 116(*a*) and upper 116(*b*) while including additional support for the player.

In addition to material type, external straps and internal supports, the upper may also materially differ in material thickness, additional external overlays to add support, perforations in the upper for breathability, etc. It is specifically contemplated that any and all combinations of the above features may be used to achieve the desired support and breathability characteristics.

The soles 114 of each shoe 100(*a*)-100(*c*) in the set 112 may be substantially similar or identical. For instance, the soles 114 of each of the shoes 100(*a*)-100(*c*) in the set 112 may include the same cushioning type. In one example shown, a bladder type cushioning system is used in the soles 114 of each shoe 100(*a*)-100(*c*) of the set 112. Although a bladder type cushioning system is used in the set 112, any known cushioning system, such as those listed above, may be used.

Figure 4A:
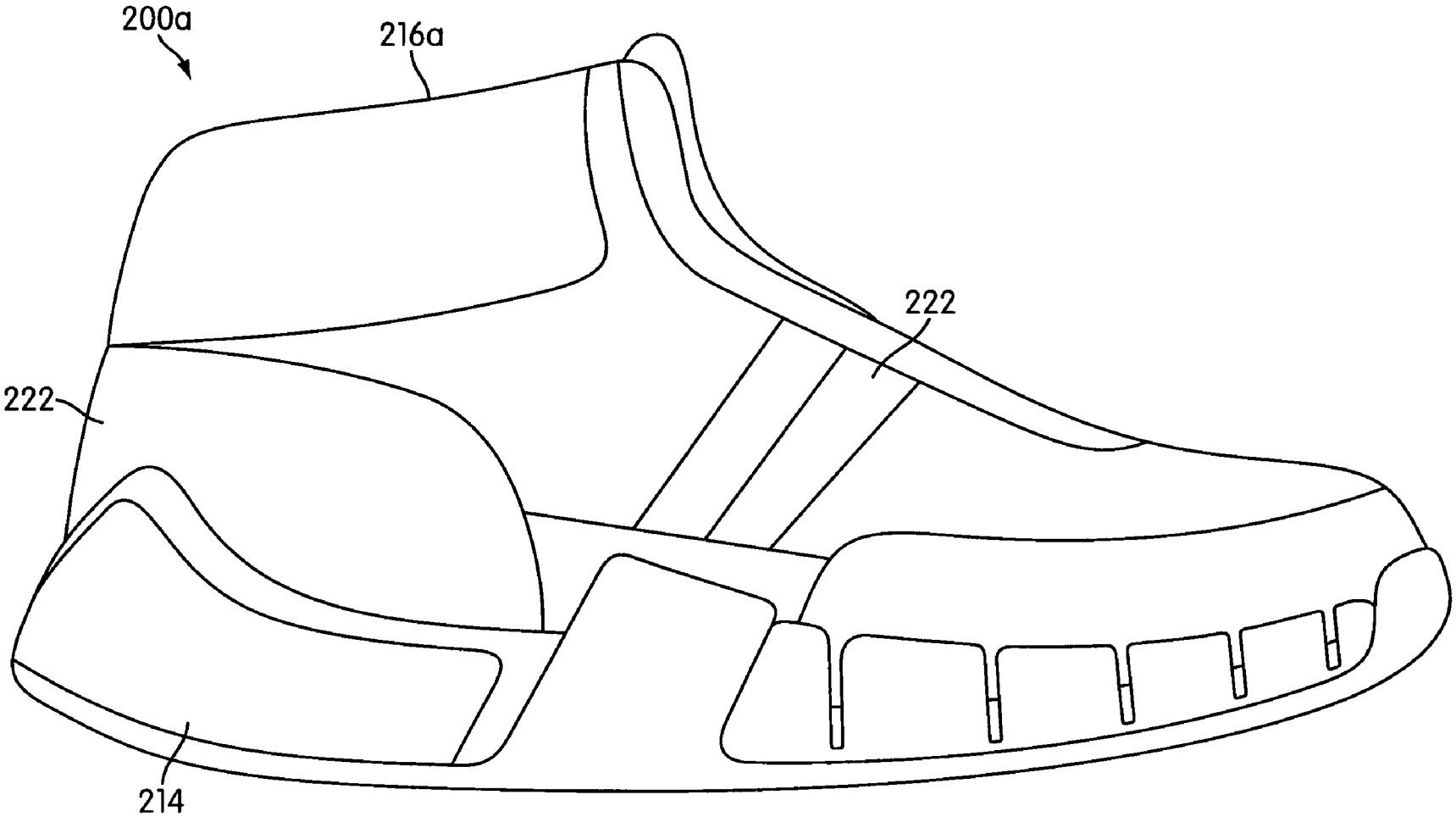
FIG. 4A is a lateral side view of one shoe from a set of articles of footwear according to this second arrangement.
Figure 4B:
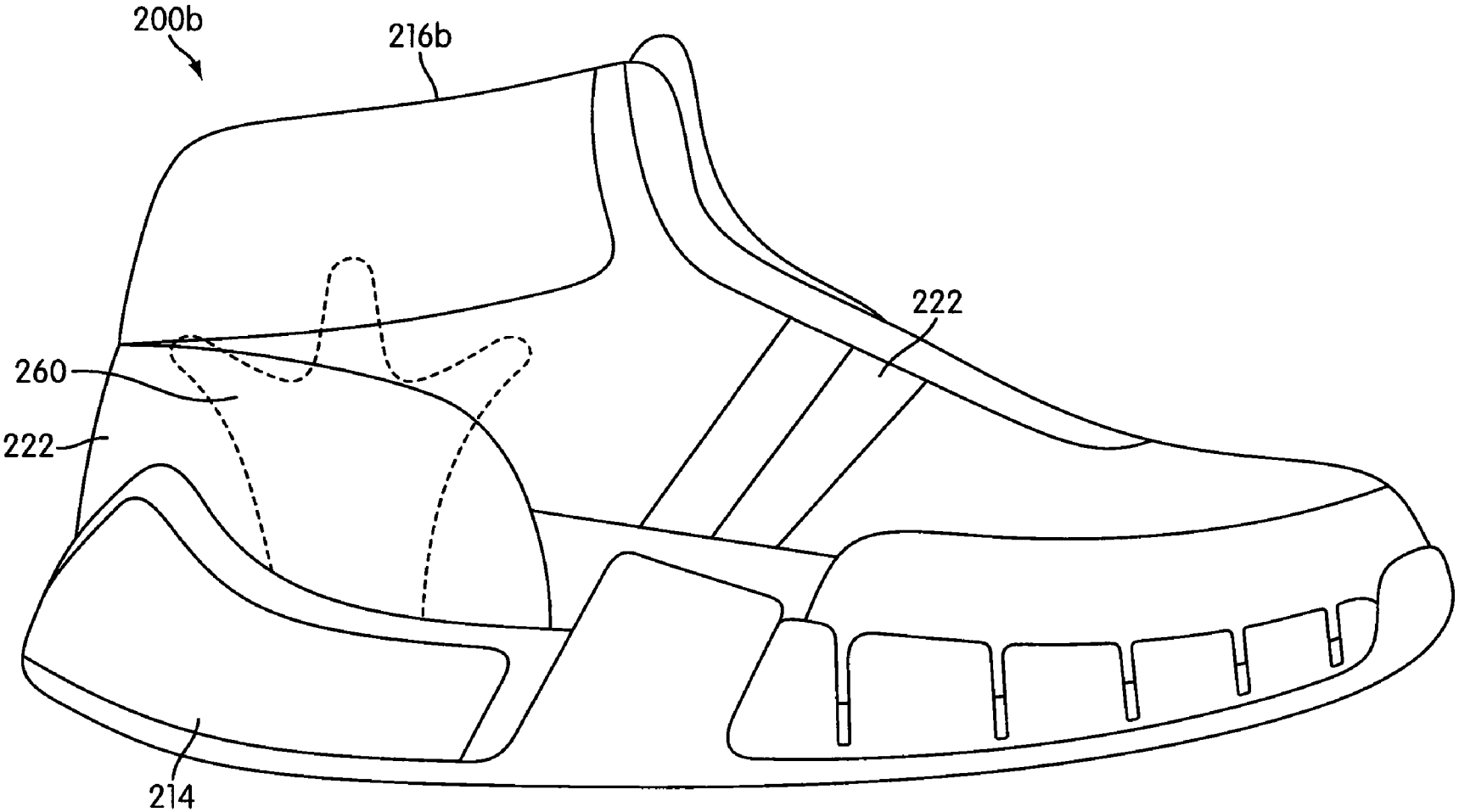
FIG. 4B is a lateral side view of a second shoe taken from a set of articles of footwear according to this second arrangement.
Figure 4C:
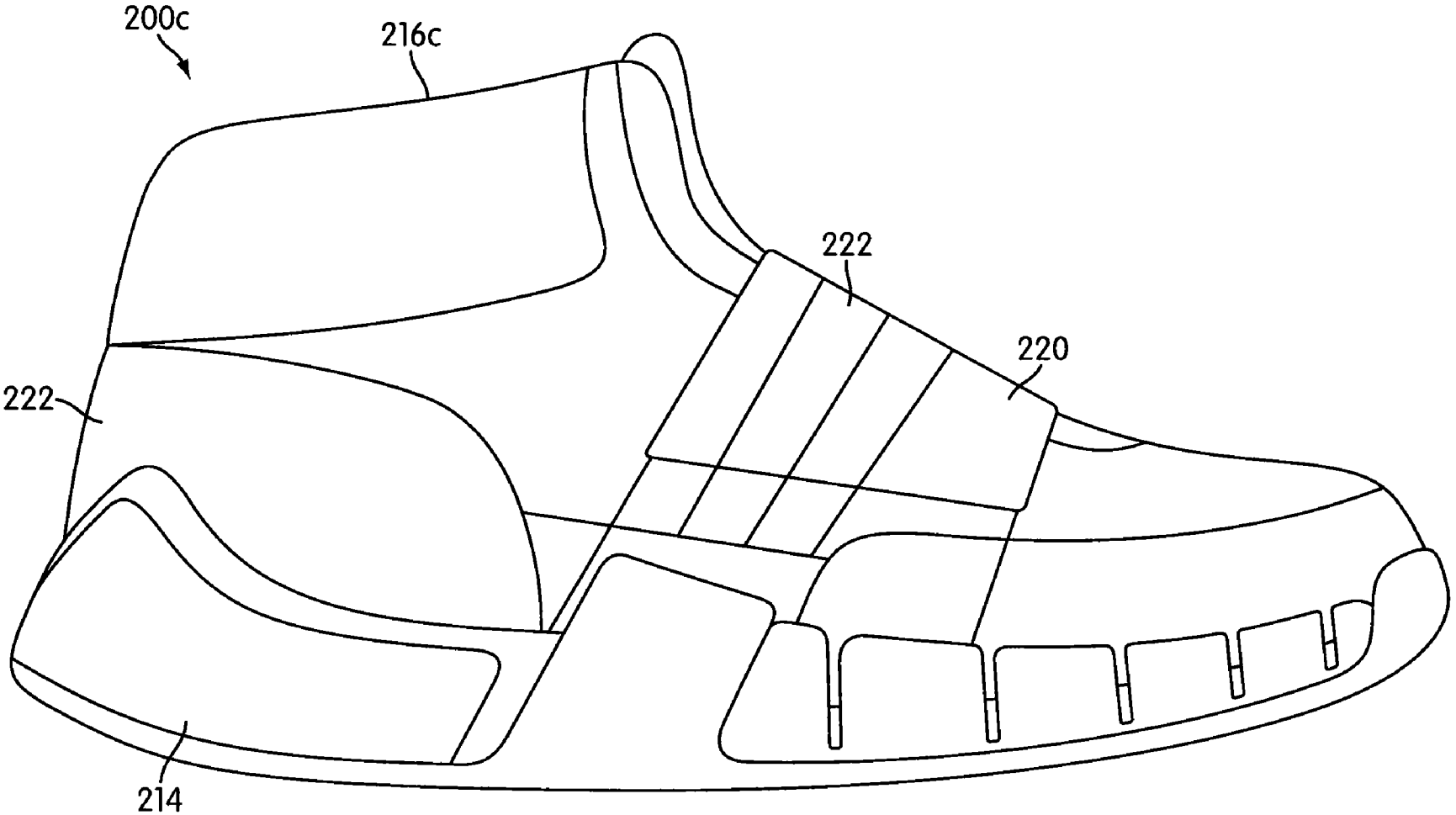
FIG. 4C is a lateral side view of a third shoe from a set of articles of footwear that could be included as part of a set of articles of footwear according to the second arrangement.

Another configuration of this arrangement is seen in FIGS. 4A-4C. The shoes 200(*a*), 200(*b*), 200(*c*) of the set in FIGS. 4A-4C each have an upper 216(*a*), 216(*b*), 216(*c*) and a sole 214. The sole 214 of each of the shoes 200(*a*)-200(*c*) is the same. For instance, each of the soles 214 may include the same cushioning type. Each shoe is shown from the lateral side. This lateral view provides a clear illustration of exemplary features of the present invention.

Referring to FIG. 4A, the shoe 200(*a*) includes an upper 216(*a*) and a sole 214. The sole 214 shown on shoe 200(*a*) may be the same as the sole 214 on the other shoes 200(*b*), 200(*c*) in the set. For instance, the shoes 200(*a*)-200(*c*) may include the same cushioning type in each sole. In one specific example shown, the shoes 200(*a*)-200(*c*) may include a foam type cushioning system in the sole 214. Although the shoes 200(*a*)-200(*c*) of FIGS. 4A-4C are shown with a foam type cushioning system, any known cushioning system, such as those listed above, may be used in the sole 214.

The upper 216(*a*) of shoe 200(*a*) in FIG. 4A includes an appearance that is substantially similar to the shoes 200(*b*), 200(*c*) of FIGS. 4B-4C. The appearance may be due to overlay shapes, stitch designs, color scheme and/or perforations regardless of size and/or proportion. As seen in FIG. 4A, the upper 216(*a*) appearance includes material overlays 222. These overlays 222 contribute to the overall appearance of the upper 216(*a*). The appearance that is created by the overlays 222 on upper 216(*a*) is maintained on every shoe 200(*b*), 200(*c*) within a set. The upper 216(*a*) may also have the same color scheme as uppers 216(*b*) and 216(*c*), contributing to the substantially similar appearance of the uppers.

Although the upper 216(*a*) of shoe 200(*a*) may have a substantially similar appearance to the uppers 216(*b*), 216(*c*) of shoes 200(*b*), 200(*c*), it may materially differ in performance specifications. For instance, the shoe 200(*a*) may be utilized by a player who requires a lightweight shoe. The upper 216(*a*) may then be formed of a lightweight material, such as nylon, rather than a heavier material, such as leather. In another example, the player may require a shoe 200(*a*) formed of a breathable material. In that instance, a breathable material may be used to form the shoe 200(*a*) used by that player, but not necessarily for the shoes of the other players on a team.

Aspects of this arrangement of the team set of shoes are further illustrated in FIG. 4B. The shoe 200(*b*) of FIG. 4B includes an upper 216(*b*) and a sole 214. The sole may be identical to the sole 214 in FIG. 4A, as well as the sole in FIG. 4C.

The upper 216(*b*) of shoe 200(*b*) may have a substantially similar appearance to the upper 216(*a*) of shoe 200(*a*). For instance, the same material overlays 222 may be utilized in the upper 216(*b*) as in upper 216(*a*). These material overlays 222 provide a substantially similar upper appearance for the uppers 116(*a*)-116(*c*) in the set.

In addition, the upper 216(*b*) of shoe 200(*b*) includes an internal support, for example a paw type support 260. This additional support may be provided to players who desire additional ankle support. Although the upper 216(*b*) includes this added support, it does not change the general outer appearance of the upper 216(*b*). The internal support may also be located midfoot, in addition to or in lieu of the ankle heel region.

FIG. 4C further illustrates aspects of this arrangement of a team set of shoes. The shoe 200(*c*) includes an upper 216(*c*) and a sole 214. The sole may be substantially similar or identical or the soles 214 of shoes 200(*a*) and 200(*b*).

The upper 216(*c*) includes material overlays 222 that provide a general upper appearance that is substantially similar to the appearance of the other uppers 216(*a*), 216(*b*) in the set. In addition, the upper 216(*c*) includes a support strap 220. The support strap 220 is fixedly attached to the upper at one end and continues the pattern of the upper to maintain the general appearance of the upper. The support strap 220 may be provided for a player who requires additional foot support, yet the upper 216(*c*) remains substantially similar in appearance to uppers 216(*a*) and 216(*b*).

This arrangement of the present invention may be provided as part of a kit. Such a kit may include a plurality of pairs of shoes, each pair with an identical sole and an upper having a substantially similar appearance to all other uppers in the set, but differing in performance specifications. The differing uppers may be due to different internal or external supports, material types, breathability, and the like. The multiple pairs of shoes could be shipped in one container via a common carrier to a single destination.

The team set of shoes may be selected based on a variety of criteria to suit the needs of each player. For example, an upper may be identified that includes a given color scheme of other design or pattern. The upper may be selected based on team characteristics, such as team colors. The particular upper for a given pair of shoes may then be selected based on the needs of each player. For example, a player desiring a lightweight breathable shoe may select an upper having a plurality of perforations. In another example, a player desiring additional lateral support may choose a stiff material, such as leather, and select an external support strap to provide additional support.

The substantially similar uppers of this arrangement allow for a team to maintain a uniform appearance in the footwear of the players. However, the differing construction of the uppers allows each player to select the upper that may enhance the player's performance, comfort and safety, without sacrificing a uniform appearance.

Figure 5:
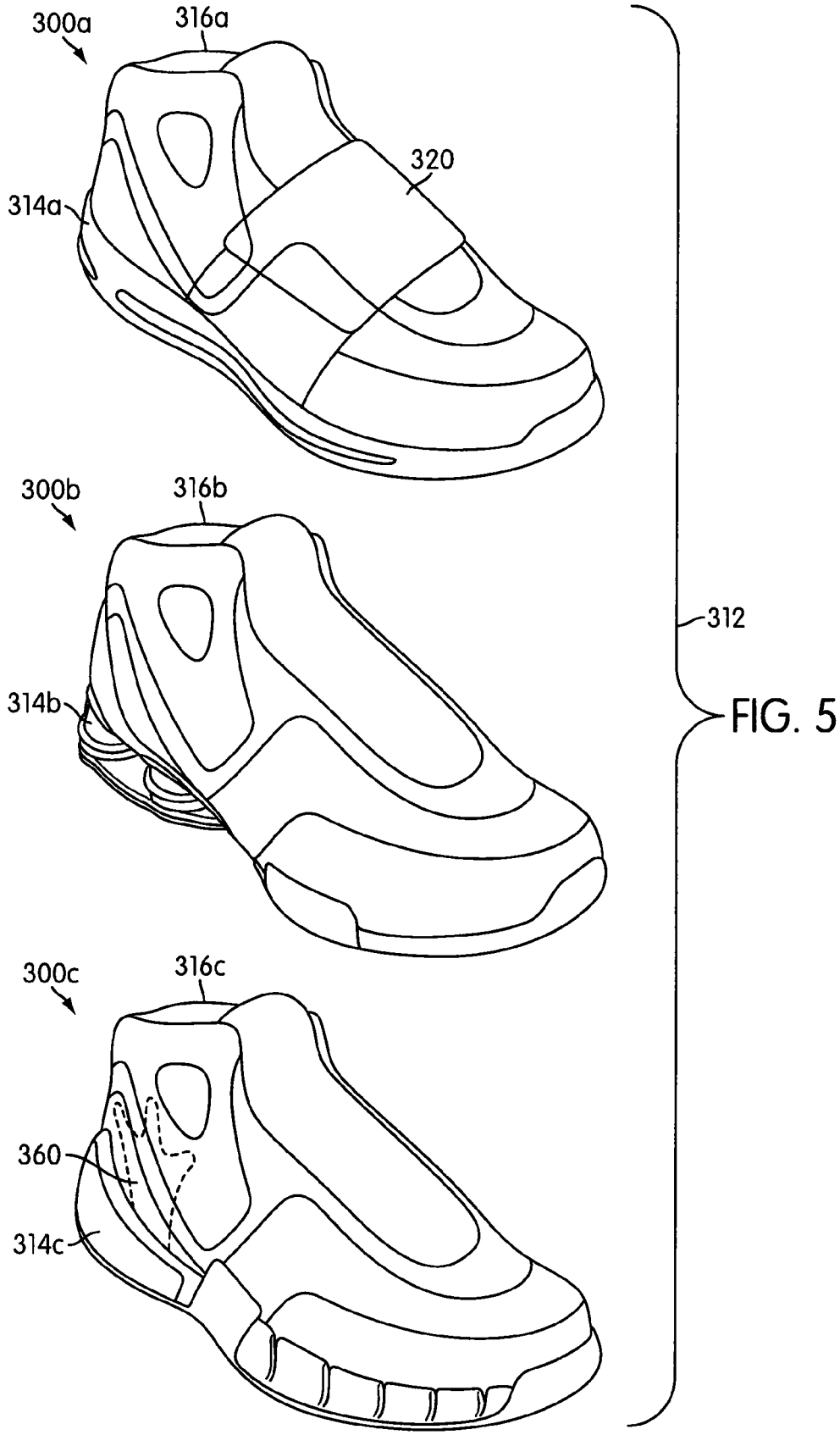
FIG. 5 is a perspective view of yet another arrangement of a set of articles of footwear according to aspects of the present invention.

FIG. 5 illustrates yet another arrangement of the team set of shoes. The shoes 300(*a*), 300(*b*), 300(*c*) of the set 312 are each one half of a pair of shoes within the set 312. Each shoe 300(*a*), 300(*b*), 300(*c*) includes an upper 316(*a*), 316(*b*), 316(*c*) and a sole 314(*a*), 314(*b*), 314(*c*).

The perspective view of shoes 300(*a*), 300(*b*) and 300(*c*) depict the uppers 316(*a*), 316(*b*), 316(*c*) having a substantially similar appearance. This substantially similar appearance may be due to material overlays, stitch patterns, color patterns, perforations, and the like, that provide the same general appearance for each upper 316(*a*)-316(*c*) within the set 312.

Although the uppers 316(*a*)-316(*c*) are substantially similar in appearance, they may be different from each other with respect to performance specifications. Such specifications may include internal and external support, material type, breathability and the like. For instance, shoe 300(*a*) includes an additional support strap 320 for players who require additional foot support. Also, shoe 300(*c*) includes an internal support 360 for players who require additional ankle support. Regardless of the additional support types utilized, each upper 316(*a*)-316(*c*) has a substantially similar appearance to the others in the set 312.

Further to FIG. 5, the soles 314(*a*)-314(*c*) of the shoes 300(*a*)-300(*c*) may differ. For instance, the soles 314(*a*)-314(*c*) may include an individualized cushioning type selected by each player. In one example, a player requiring greater stability may select a foam type cushioning system, as in shoe 300(*c*). The cushioning type may be selected by each player and may be based on the player's preferences. The selection may take into account the requirements of the player such as medical needs, performance needs, personal preference, and the like.

The individualized sole, coupled with the individualized upper may provide a shoe that includes all characteristics desired by a player, but maintains the uniform appearance by way of the substantially similar upper appearance. For instance, this arrangement maintains the uniform look of the team's shoes while allowing each player on a team to select the cushioning type and upper that will enhance the performance, comfort and safety of that player.

This arrangement of the present invention may also be provided as part of a kit. Such a kit may include a plurality of pairs of shoes, each pair having an upper with a substantially similar appearance to the other uppers in the set. In addition, the kit may include each pair having an individualize sole and upper, selected by each player, to enhance that player's comfort, performance and safety. The multiple pairs of shoes could be shipped in one container via a common carrier to a single destination.

While the various features of the team set of shoes work together to achieve the advantages previously described, it is recognized that individual features and sub-combinations of these features can be used to obtain some of the aforementioned advantages without the necessity to adopt all of these features. The present invention is disclosed above and in the accompanying drawings with reference to a variety of embodiments. The purpose served by disclosure of the embodiments, however, is to provide an example of the various aspects embodied in the invention, not to limit the scope of the invention. One skilled in the art will recognize that numerous variations and modifications may be made to the embodiments without departing from the scope of the present invention, as defined by the appended claims.

What is claimed is:

1. A team set of shoes comprising:

a first pair of shoes and a second pair of shoes, the first pair of shoes having an upper including a first appearance type having:

a first pattern scheme; and a first plurality of appearance elements; and first performance specifications having a first plurality of structural elements, wherein the first plurality of structural elements include first support elements and first breathability elements;

the second pair of shoes having an upper including:

the first appearance type having the first pattern scheme and the first plurality of appearance elements, and second performance specifications having a second plurality of structural elements different from the first plurality of structural elements, wherein the second plurality of structural elements include second support elements and second breathability elements, wherein the first support elements are different from the second support elements or the first breathability elements are different from the second breathability elements.

2. The team set of shoes of claim 1, wherein the first plurality of structural elements and the second plurality of structural elements include different material types and the first and second pairs of shoes includes identical soles.

3. The team set of shoes of claim 1, wherein the first plurality of structural elements include an external support strap and the second plurality of structural elements are void of a similar support strap.

4. The team set of shoes of claim 3, wherein the external support strap is fixedly attached to the upper at one end.

5. The team set of shoes of claim 3, wherein the external support strap continues the first pattern scheme formed by overlays on the upper of the first pair of shoes.

6. The team set of shoes of claim 1, wherein the first pair of shoes includes an additional internal support and the second pair of shoes is void of a similar internal support.

7. The team set of shoes of claim 1, further including a third pair of shoes, the third pair having an upper with the first appearance type having the first pattern scheme and first plurality of appearance elements.

8. The team set of shoes of claim 7, wherein the third pair includes third performance specifications having a third plurality of structural elements different from the first plurality of structural elements and the second plurality of structural elements and including third support elements and third breathability elements.

9. The team set of shoes of claim 8, wherein the third plurality of structural elements includes a material type different from at least one of the first and second pairs.

10. The team set of shoes of claim 1, wherein the first and second pairs of shoes are contained in a kit.

11. The team set of shoes of claim 1, including at least five pairs of shoes, wherein the uppers of each of the at least five pairs include the first appearance type having the first pattern scheme and first plurality of appearance elements and wherein the performance specifications including the plurality of structural elements associated therewith of each of the at least five pairs are materially different from all other pairs.

12. A method of providing a set of shoes to multiple players on a team, the method comprising:

identifying an upper having an appearance type including a pattern scheme and appearance elements, and performance specifications for each player on the team; and providing a set of shoes, each pair of shoes in the set of shoes having an upper with the appearance types, and materially different performance specifications, including a plurality of structural elements based on the identified performance specifications for each player.

13. The method of claim 12, further comprising the step of identifying the appearance type based on properties relating to the team.

14. The method of claim 12, wherein the providing step further includes providing at least five pairs of shoes in the set of shoes.

15. A team set of shoes, comprising:

a first pair of shoes and a second pair of shoes;

the first pair of shoes having a first upper, the first upper including:

a first appearance type having a first pattern scheme and a first plurality of appearance elements, first performance specifications including a first plurality of structural elements, and;

a first sole type; and the second pair of shoes having second upper, the second upper including:

the first appearance type having the first pattern scheme and the first plurality of appearance elements, second performance specifications including a second plurality of structural elements different from the first plurality of structural elements; and a second sole type;

wherein the first plurality of structural elements includes an internal support and the second plurality of structural elements are void of a similar internal support.

16. The team set of shoes of claim 15, wherein the first plurality of structural elements further includes an external support strap, fixedly attached to the first upper at one end and continuing the pattern scheme formed by overlays on the first upper, and the second plurality of structural elements are void of a similar external support strap.

17. The team set of shoes of claim 15, wherein the first and second pair are formed of different material types.

18. The team set of shoes of claim 15, wherein the first sole type is different from the second sole type.

19. The team set of shoes of claim 15, wherein the first and second pairs of shoes are contained in a kit.

* * * * *